United States Patent [19]

Rheinheimer

[11] 4,013,120

[45] Mar. 22, 1977

[54] AIR CONDITIONER

[76] Inventor: Martin Rheinheimer, 190 Wentworth, Glencoe, Ill. 60022

[22] Filed: Aug. 20, 1975

[21] Appl. No.: 606,174

Related U.S. Application Data

[63] Continuation of Ser. No. 435,286, Jan. 21, 1974, abandoned.

[52] U.S. Cl. ..... 165/48; 62/263; 165/56

[51] Int. Cl.[2] ..... F25B 29/00; F24H 9/08

[58] Field of Search ..... 165/48, 50, 56; 62/263, 62/259

[56] References Cited

UNITED STATES PATENTS

| | | | |
|---|---|---|---|
| 3,128,610 | 4/1964 | Moore | 163/56 |
| 3,308,634 | 3/1967 | Smith | 62/263 |
| 3,722,580 | 3/1973 | Brauer | 165/50 |
| 3,823,768 | 7/1974 | Finger | 165/48 |

*Primary Examiner*—Charles J. Myhre
*Assistant Examiner*—Theophil W. Streule, Jr.
*Attorney, Agent, or Firm*—Allegretti, Newitt, Witcoff & McAndrews

[57] ABSTRACT

The self contained, combined cooling and heating, air conditioning unit comprises a vertically elongated, generally rectangular cabinet adapted to be disposed in a vertically elongated, generally rectangular, relatively narrow opening formed in the exterior wall of an apartment building, small office building, townhouse or similar building wherein it is desired to have independent temperature control for the rooms and wherein the exterior building wall is, to a relatively large extent, glass or windows. A vertically disposed wall divides the interior of the cabinet into an inside compartment and an outside compartment which is in communication with the exterior of the building by means of an outside fresh air grille that extends substantially the entire vertical length of the outside facing end wall of the cabinet.

3 Claims, 5 Drawing Figures

AIR CONDITIONER

This is a continuation of copending application Ser. No. 435,286 filed on Jan. 21, 1974 and now abandoned.

BACKGROUND OF THE INVENTION

The present invention relates to an improved, self contained air conditioning unit, and more particularly, to an improved self contained, combined cooling and heating, air conditioning unit adapted for use in an apartment building, small office building, townhouse or the like wherein independent temperature or comfort control for the individual rooms or sets of rooms is desired, and wherein the exterior wall of the building comprises, to a relatively large extent, glass or windows.

In recent years, there has been a trend towards providing completely independent comfort controls for individual apartments, for the separate office suites in small office buildings, for townhouses and for the like. The trend has been accelerated due to the shift to condominium ownership of many such buildings, and additionally, due to the fact that owners have found it more convenient and economical to free themselves of the burdens of providing comfort acceptable to the satisfaction of all tenants in a building.

Generally in the past, such independent comfort control has been achieved by the utilization of conventional, through the wall, horizontally disposed air conditioning units on a room to room basis. Alternative air conditioning systems have been available but have a significant commercial disadvantage in that such systems require the remote installation of the condenser component on, for example, building balconies. This, of course, not only restricts the use of the balconies but in addition, detracts from the exterior appearance of the building. Also there have been commercially available air conditioning units which comprise a pair of separate cabinets stacked one on top of the other. These units are relatively wide and thus occupy a significant portion of the building perimeter wall. In addition, access to these units for maintenance and repair is only available from the exterior of the building.

Furthermore, in the construction of apartments, (high-rises, medium rises and garden types) economic considerations and zoning densities today dictate that the architect maximize the use of the building perimeter wall in terms of room allocation, and it is, therefore, imperative that the impact of the comfort control equipment on the perimeter "skin" or exterior wall of the building be held to the minimum. Glass is being more and more utilized by architects as the "skin" of buildings for economy reasons and for visual-spacial effects. Conventional, through the wall, air conditioning units present considerable design problems in buildings utilizing a glass "skin" both from a practical and aesthetic standpoints.

In addition, the conventional, through the wall air conditioning units present aesthetic and practical problems with respect to interior of the rooms. The units are frequently required to be mounted so that the grille tends to "stare" out into the room from the exterior wall which is often the focal wall of the room from the standpoint of visual and spacial emphasis. A separate air conditioning unit is generally required for each room in order to provide independent room comfort, particularly with respect to the rooms adjacent to the exterior wall of the building. Also if such a unit needs to be repaired, the entire unit must either be removed from the wall or access to the unit must be had from the exterior of the building.

The improved air conditioning unit of the present invention overcomes the aforementioned problems with respect to the utilization of conventional, through the wall, air conditioning units. The improved air conditioning unit comprises a vertically elongated, relatively narrow, generally rectangular cabinet which can be disposed in the exterior wall of the building between adjacent rooms or adjacent windows and which requires minimal space along the perimeter of the building. This, of course, maximizes design freedom for the architect since he can utilize full room, floor to ceiling, windows in designing the building. In addition, the improved air conditioning unit permits the air return and air supply openings to be directed in a plane parallel to the building perimeter or exterior wall as well as in a plane perpendicular to the building perimeter wall. This advantageous feature not only minimizes the unsightliness of the cabinet from an interior design standpoint, but also permits the improved air conditioning unit to deliver conditioned air to two side by side rooms when the cabinet is disposed in the interior wall between the rooms. Lastly, ready access to the working components of the improved air conditioning unit can be had from the interior of the building and without the necessity of damaging the surrounding decorative finish of the rooms by means of an access door in the side wall of the cabinet.

More specifically, the cabinet of the improved self contained, air conditioning unit of the present invention includes a vertically elongated, relatively narrow inside and outside facing end walls, relatively narrow top and bottom walls, and relatively wide side walls and is adapted to be disposed, at least in part, within a vertically elongated, generally rectangular, relatively narrow opening formed in the exterior building wall between adjacent pieces of glass or windows. The cabinet is vertically divided into an inside compartment and an outside compartment by a wall that prevents air communication between the compartments. The outside compartment is in air communication with the exterior of the building through an outside fresh air grille which is mounted in the outside facing end wall and which extends substantially the entire length and width of the outside facing end wall. The inside compartment is in air communication with the interior of the building through an air supply grille and an air return grille mounted in the cabinet adjacent to the top and bottom walls, respectively, of the cabinet. The air supply and air return grilles may be mounted in the inside facing end wall or in one or both of the side walls of the cabinet. This feature permits the improved unit to be utilized to provide conditioned air either directly to a single room and in planes parallel or perpendicular to the building perimeter wall or if the unit is positioned in an interior building wall, to two adjacent rooms, and thus, affords an architect or interior designer considerable design freedom in creating the interior designs of the apartments or offices.

The heating and cooling system components of the improved air conditioning unit are all disposed within the cabinet. The evaporator component and the air heaters are disposed in the inside compartment in the path of the air flow from the air return grille to the air supply grille. An air blower, also disposed in the inside compartment, provides for a controlled flow of air along this air flow path from the air return grille to and through the air supply grille. The compressor and condenser components are disposed in the outside compartment, with the condenser components being positioned adjacent to the outside fresh air grille and extending substantially the entire vertical length of the outside fresh air grille. An air fan unit is also disposed in the outside compartment so as to cause fresh air from the exterior of the building to pass across the condenser component.

The side wall of the cabinet includes a door which permits ready access to all the heating and cooling system components. Thus, these components can be easily repaired or replaced by a person working in the interior of the building without the need to cause damage to the decorative finish of the room.

In view of the foregoing, it is a primary object of the present invention to provide an improved, self contained air conditioning unit for apartment buildings, small office buildings, townhouses and other similar buildings wherein the exterior or perimeter wall of the building is, to a large extent, glass or windows and wherein it is desired to provide independent temperature and comfort control for the individual rooms in the building. A related object of the present invention is to provide an improved self contained air conditioning unit which comprises a vertically elongated, relatively narrow, generally rectangular cabinet that is adapted to be disposed in a vertically elongated, relatively narrow, generally rectangular opening in the exterior building wall, that has a door permitting ready access, from the interior of the building, to the heating and cooling system components disposed in the cabinet and that can provide conditioned air in a plane parallel to the perimeter wall of the building and directly to two adjacent rooms.

These and other objects and advantages of the present invention will be apparent to those skilled in the art from a reading of the following description of the preferred embodiment of this invention and a review of the accompanying drawings.

Figure 2:
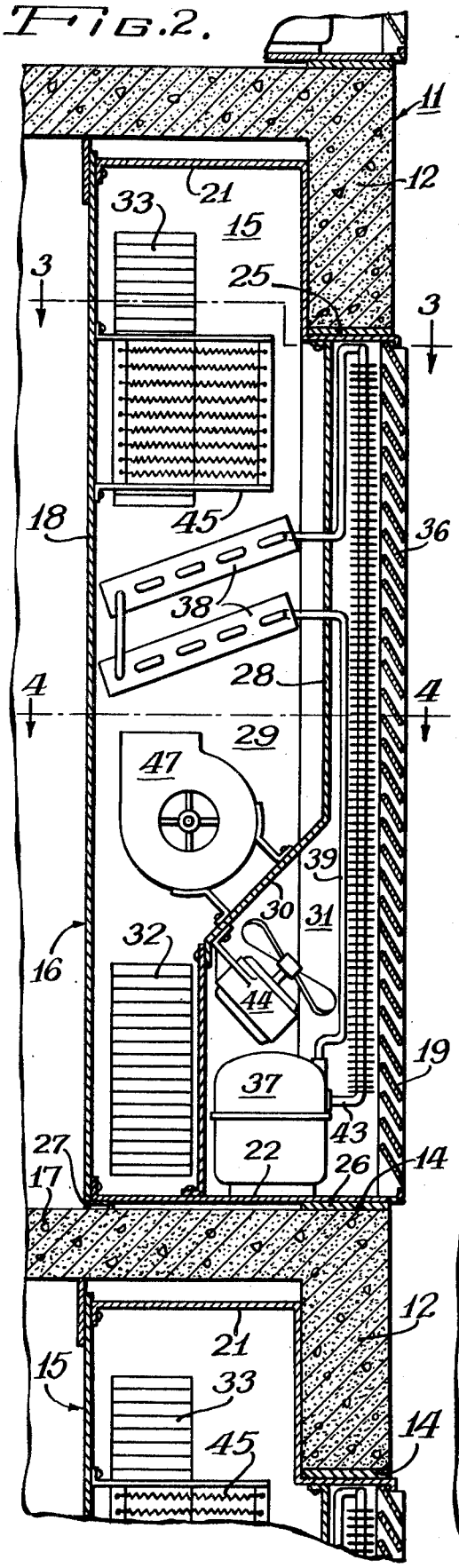
FIG. 2 is a vertical, cross sectional view taken along line 1—1 in FIG. 1.

Throughout the various figures of the drawings the same reference numerals will be used to designate the same or substantially the same parts of the improved air conditioning unit shown in the drawings. More over, when the terms "right", "left", "right end", "left end", "inside" and "outside" are used herein, it is to be understood that these terms have reference to the structure shown in the drawing as it would appear to a person viewing the drawings.

DESCRIPTION OF THE PREFERRED EMBODIMENT

Figure 1:
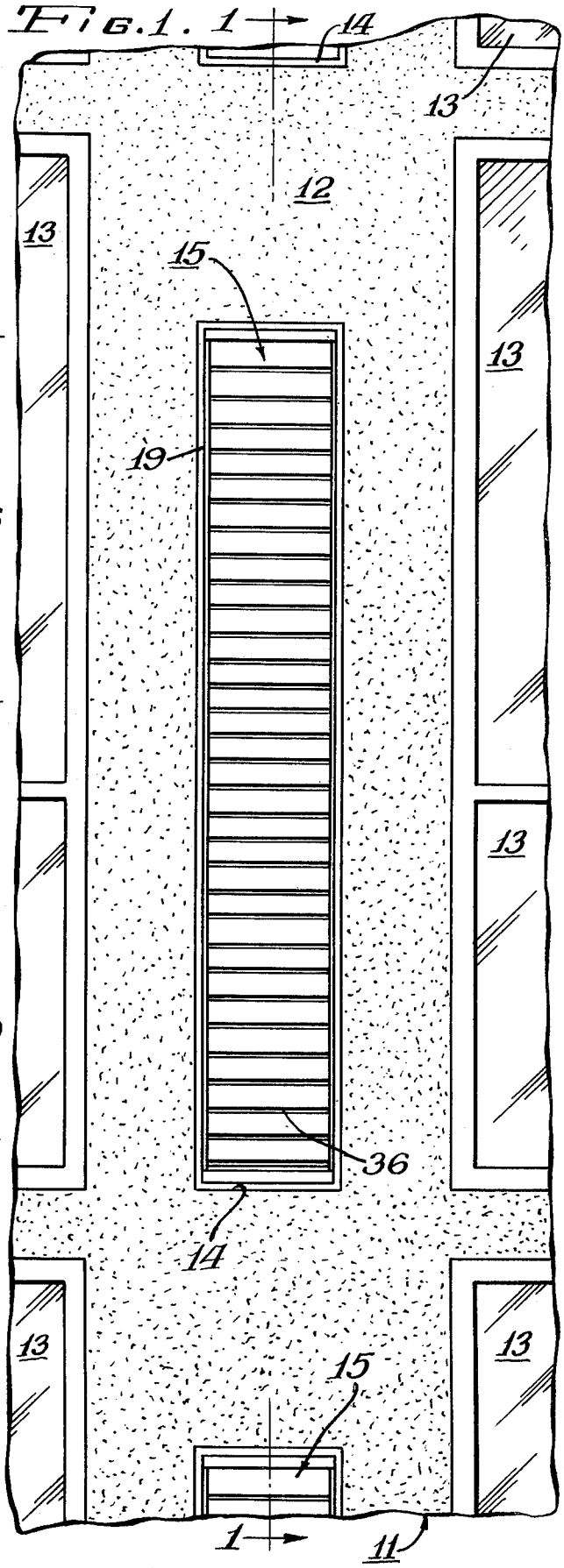
FIG. 1 is a plan view of a portion of the exterior wall of a building, looking from the exterior of the building, and showing the improved air conditioner unit of the present invention disposed in an opening in the exterior building wall between two adjacent windows.

As noted above, the improved air conditioning unit of the present invention is adapted for use in apartment building, small office buildings, townhouses or similar buildings wherein the exterior or perimeter wall of the building is, to a large extent, glass or windows and wherein independent, comfort or temperature control is desired for the individual rooms or offices in the building. Referring to FIGS. 1 and 2, a multi-story building, shown generally at 11, has a perimeter or exterior wall 12 that to a large extent, consists of glass, floor to ceiling, windows 13. A plurality of vertically elongated, relatively narrow, generally rectangular openings 14 are formed in the exterior wall 12, one between the sides of each pair of adjacent windows 13. Improved air-conditioning units, shown generally at 15, embodying my invention are disposed, at least in part, in each of these openings 14. Since each of these air conditioning units 15 is structurally and functionally identical, only one such unit will be hereinafter described.

The improved air conditioning unit 15 comprises a vertically elongated, relatively narrow, generally rectangular cabinet 16 which is mounted on the floor 17 of the building 11. The cabinet 16 includes a vertically elongated, relatively narrow, inwardly facing end wall 18; a vertically elongated, relatively narrow outwardly facing end wall 19; top and bottom walls 21 and 22, respectively; and relatively wide, in a horizontal direction, side walls 23 and 24. A reduced height and width neck portion 25 is formed, as an integral part of the cabinet 16, by reducing the width of the side walls 23 and 24 and the height of the top wall 21 adjacent to right end of the cabinet 16. The width and height of the neck portion 25 are selected so that the neck portion can snugly fit within the opening 14 formed in the exterior building wall 12. A shim 26 and channel 27 are disposed between the floor 17 and the bottom wall 22 to assure that the neck portion 25 fits correctly within the opening 14 when the cabinet is properly mounted on the floor 17.

A vertical wall 28 extends from the top wall 21, i.e. more particularly, from the portion of the top wall which overlies the neck portion 25, to the bottom wall 22 and between the side walls 23 and 24 so as to divide the interior of the cabinet into an inside compartment 29 and an outside compartment 31. The wall 28 has an offset portion 30, offset to the left, approximately midway between the top wall of the neck portion 25 and the bottom wall 22. The vertical wall 28 prevents air communication between the compartments 29 and 31.

Figure 3:
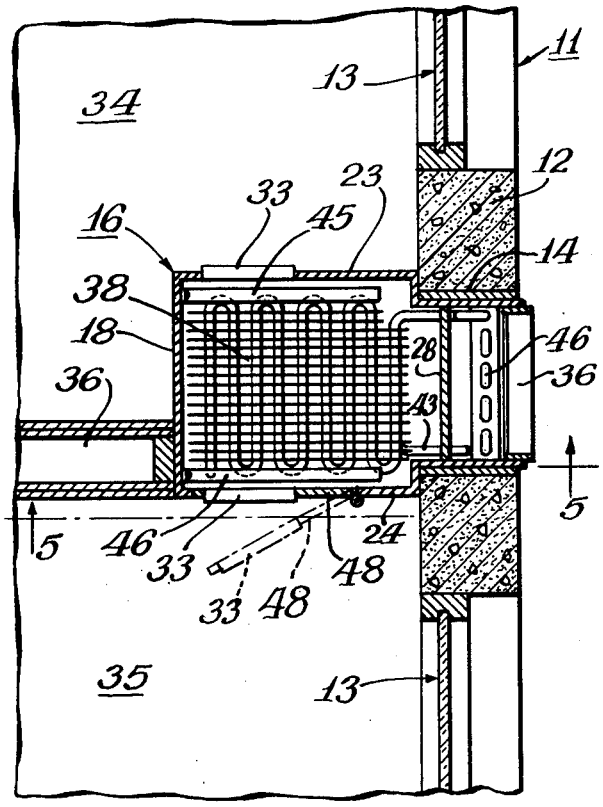
FIG. 3 is a horizontal, cross sectional view taken along line 3—3 in FIG. 2.
Figure 4:
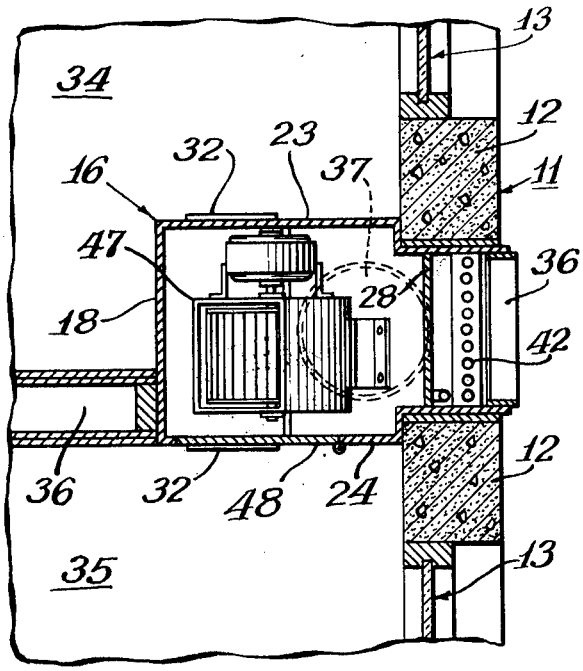
FIG. 4 is a horizontal cross sectional view taken along line 4—4 in FIG. 2.
Figure 5:
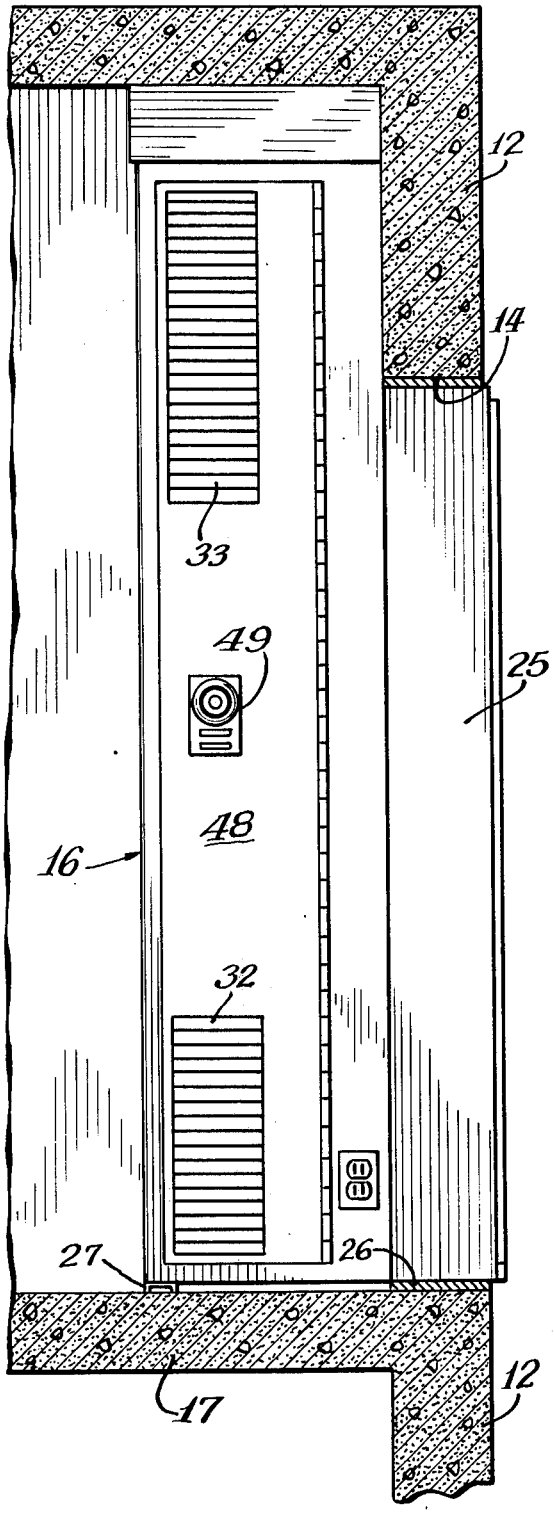
FIG. 5 is a vertical partial plan view taken along line 5—5 in FIG. 3.

Referring now to FIGS. 2, 3 and 4, the side wall 23 and 24 each include an air return grille or register 32 and an air supply grille or register 33. These grilles 32 and 33 permit air communication between the interior of the compartment 29 and the interior of the rooms 34 and 35 in the building 11 when, as shown in FIGS. 3 and 4, the cabinet 16 is disposed in an interior wall 36 that lies in a plane substantially perpendicular to the plane of the exterior wall 12. In other words, the air conditioning unit 15 has the important commercial advantage in that it is able to provide conditioned air to two side-by-side rooms by means of the arrangement of the grilles disposed in the side walls 23 and 24 of the cabinet 16.

An outside fresh air grille or louver 36 is mounted in the outer facing end wall 19. As best shown in FIGS. 1 and 2, this grille 36 extends substantially the entire vertical length of and is the same horizontal width as the wall 19 which as noted above, is substantially the same vertical length and horizontal width as the opening 14. The fresh air grille 36 permits the ingress of fresh air from the exterior, i.e. the outside building, into outer compartment 31 and egress of air from compartment 31 to the exterior or outside of the building, while preventing, or at least minimizing, the entrance of snow, rain or the like into the outside compartment 31.

The cooling and heating system components utilized in the air conditioning unit 15 are of conventional design and construction and function in a standard manner. Preferably and to facilitate installation of the cabinet 16 and the operation of the unit 15, all of the cooling and heating system components are electrically powered and require no external water piping and no external condensate lines. These components include a standard compressor unit 37 which is interconnected with a standard evaporator unit 38 by means of piping or tubing 39. The evaporator unit 38 is connected, by means of piping or tubing 41, to the upper end of a standard, finned condenser unit 42 whose lower end is, in turn, connected to the compressor 37 by means of piping or tubing 43. The compressor unit 37 is mounted in the outer compartment 31 on the bottom wall 22 of the cabinet 16. The condenser unit 42 is also mounted in the outer compartment 31 adjacent to the fresh air grille 36 as to provide maximum heat transfer between the unit 42 and the fresh air flowing into and out of the outer compartment 31 from the exterior of the building. To facilitate the flow of air through the grille 36, a conventional electric motor driven fan unit 44 is mounted in the outer compartment 31 on the offset portion 30 of the wall 28. This fan unit 44 causes a constant flow of air to pass across the condenser unit 42.

As best illustrated in FIGS. 3 and 4 the heating component of the heating and cooling system includes a pair of standard electric heater units 45 and 46 mounted in the inner compartment 29 on the inwardly facing end wall 18 so that the heater unit 45 is adjacent to and located just upstream from the grille 33 in the side wall 23 and the heater unit 46 is adjacent to and located just upstream from the grille 33 in the side wall 24. A conventional motor driven air blower unit 47 is mounted in the inner compartment 29 on the offset portion 30 of the vertical wall 28. The blower unit 47 assures that a controlled flow of air will pass from the interior of the rooms 34 and 35 into the inner compartment 29 through the grilles 32. The blower unit 47 also causes air in the inner compartment 29 to flow through the inside compartment 29, along a predetermined path across the evaporator unit 38 and the heating units 45, out of the compartment 29 through the grille 33 and back into the rooms 34 and 35.

As an example of cooling system components which could afford a one ton cooling capacity, the compressor 37 could be a Tecumseh Model No. AK 5510E manufactured by Tecumseh Products of Tecumseh, Mich., the blower unit 47 could be Dayton Model No. 2C962 manufactured by the Dayton Electric Manufacturing Company of Northbrook, Ill. and the fan unit 44 could be a Dayton Model No. 2C354 manufactured by the same company. Similarly the heater units 45 and 46 could be Brasch Electric, 2 stage, 7.5 KW coil units manufactured by Brasch Manufacturing Co., Inc. of Maryland Heights, Mo.

The side wall 24 includes a hinged access door 47 which is normally closed but which may be manually opened to provide access to the interior of the cabinet 16. The door 47 carries the air return grilles 32 and air supply grilles 33 that afford air communication between the inside compartment 29 and the room 35, and is of sufficient size such that when fully opened, as shown in phantom in FIG. 3, ready access to all of the components of the heating and cooling system can be had from the interior of room 35. The advantage of the inclusion of this door in the cabinet 16 is that all these components can be repaired, in situ, by person in room 35 or can be removed from the cabinet through the door 47 without dismantling the cabinet and without disturbing the decorative finish on the walls 12 and 36 of the room 35. A conventional thermostatic control 48 is likewise mounted on the door 47 and is interconnected by circuitry, not shown, with the compressor 37, fan unit 44, blower unit 47 and heater units 45 and 46 so as to control the operation of the heating and air cooling system components and thereby provide temperature or comfort control for the rooms 34 and 35.

As noted above, one of the principal, commercially attractive advantages of the improved air conditioner of the present invention is that it provides a compact, vertically elongated, relatively narrow cabinet which can house all of the heating and cooling system components required to provide independent temperature or comfort control for a room or adjacent perimeter rooms and which only requires minimal space in the perimeter wall of the building. In this regard, a cabinet 16, sufficient to house the heating and cooling system components having cooling capacities of between 9,000 to 23,000 BTU and having a heating capacity of 4KW to 10.5 KW, may have a height of approximately 90 inches, a width, between the side walls 23 and 24, of approximately 14 inches and a depth, between the end walls 18 and 19, of approximately 35 inches, with the depth of the neck portion 25 being approximately 8 inches. Thus by using the improved air conditioner of the present invention, the architect gains a markedly increased degree of design freedom and flexibility in the design of the interior and exterior of a building. The air conditioning unit 15 may also be constructed so that only minimal on site labor is required to install the unit in the building 11, and in fact, the only labor required is to connect the cabinet with a source of electrical power in the building.

While the above is a description of the preferred embodiment of the invention, modifications and changes obviously could be made in the above described air conditioning unit 35 without departing from the spirit of my invention. For example, the neck down portion 25 could be eliminated so that the cabinet 16 would have more regular, rectangular configuration. This could be accomplished by reducing the overall height and width of the unit 15 or enlarging the height and width of the opening 14 or a compromise between the two. Similarly the compressor unit 37 and fan unit 44 could be mounted in the inner compartment 29 rather than the outer compartment 31 so long as the fan unit 44 would be connected by duct work to the interior of the outer compartment 31. The size of the fresh air grille 36 could be made smaller than the overall size of the outwardly facing end wall 19 although it is believed that by making the size of the grille 36 coextensive with the size of the end wall, improved heat transfer characteristics will be obtained. Also the vertical wall 28 need not extend downwardly to the bottom wall 22 out if desired, could have its lower end bent so as to contact either end walls 18 or 19 adjacent their lower ends. Similarly the door 47 could be installed in either side walls 23 or 24 and the unit 15 could be utilized, by means of connected duct work to deliver conditioned air to other, remote rooms.

Finally from the foregoing it should be apparent to those skilled in this art that various other modifications and changes of the improved air conditioning unit 35 are possible. Therefore, while a detailed description of this preferred embodiment of the present invention has been provided hereinabove, it is to be understood that all equivalents obvious to those having ordinary skill in this art are to be included in the scope of my invention as claimed.

What is claimed is:

1. An improved self contained air conditioning unit for heating and cooling the air in at least one room of an apartment building, small office building, townhouse or the like and adapted for heating and cooling the air in a room adjacent to the one room wherein independent temperature control is desired for heating and cooling the air and wherein the exterior building wall of the one room comprises floor to ceiling glass or windows except for a vertically elongated, generally rectangular, relatively narrow opening which is disposed adjacent to and along the side of the glass or windows, and which extends vertically from adjacent to the floor to adjacent to the ceiling in the one room, the improved air conditioning unit comprising:

a vertically elongated, generally rectangular cabinet including a vertically elongated, relatively narrow outside facing end wall, a vertically elongated, relatively narrow inside facing end wall, relatively narrow top and bottom walls, and two relatively wide side walls, with at least a portion of the cabinet adapted to be disposed in the opening in the exterior building wall such that the outside facing end wall of the cabinet is in communication with the exterior of the building and is substantially flush with the exterior surface of the exterior building wall, with the distance between the outside facing and inside facing end walls being greater than the thickness of the exterior building wall so that the inside facing end wall of the cabinet is disposed within the one room and is spaced from the interior surface of the exterior building wall and so that a substantial portion of at least one of the side walls of the cabinet is disposed within the one room and projects inwardly from the interior surface of the exterior building wall, and with the top and bottom walls of the cabinet being adjacent to the ceiling and floor of the one room;

a generally vertical wall extending between the side walls of the cabinet and dividing the cabinet into an outside compartment and an inside compartment, with the generally vertical wall preventing air communication between the inside and outside compartment;

an outside fresh air opening mounted in the outside facing end wall of the cabinet so as to permit fresh air communication between the outside compartment and the exterior of the building with the outside fresh air opening extending substantially the entire vertical length of the outside facing end wall;

a return register opening mounted in the substantial portion of one of the side walls of the cabinet and adjacent to the bottom wall of the cabinet so as to permit return air from the interior of the room ingress to the inside compartment;

a supply register opening mounted in the substantial portion of one of the side walls of the cabinet and adjacent to the top wall of the cabinet so as to permit conditioned air egress from the inside compartment to the interior of the one room, with the return register opening, the supply register opening and the inside compartment being arranged such that air will flow from the return register opening, through the inside compartment and out the supply register opening along a predetermined, generally vertical air path;

means for cooling the air flowing along the predetermined air path and disposed entirely within the cabinet, the cooling means including interconnected compressor means, evaporator means and condenser means, with the evaporator means being disposed in the inside compartment in the predetermined air path and the condenser means being disposed in the outside compartment adjacent to the outside fresh air opening; and air blower means mounted in the inside compartment for drawing air into the inside compartment through the return register opening and blowing the air along the predetermined path, across the evaporator means and out of the inside compartment through the supply register opening.

2. The improved air conditioning unit described in claim 1 wherein a side wall of the cabinet includes a normally closed access means which, when open, permits ready access to the components of the unit from the interior of the one room; wherein the condenser means extends substantially the entire vertical length of the outside fresh air opening; and wherein fresh air fan means are mounted in the outside compartment so as to cause fresh air from the exterior of the one room to pass across the condenser means.

3. The improved air conditioning unit described in claim 1 wherein an interior building wall abuts the inside facing end wall of the cabinet; wherein the cabinet forms a part of the interior building wall that serves to separate the one room from the adjacent room; wherein a substantial portion of the other wide wall of the cabinet faces and is in communication with the interior of the adjacent room; wherein a second return register is mounted in the substantial portion of the other side wall adjacent to the bottom wall of the cabinet so as to permit return air from the interior of the adjacent room ingress to the inside compartment; and wherein a second supply register opening is mounted in the substantial portion of the other side wall adjacent to the top wall of the cabinet so as to permit conditioned air egress from the inside compartment to the interior of the adjacent room.

* * * * *

UNITED STATES PATENT OFFICE

CERTIFICATE OF CORRECTION

PATENT NO. : 4,013,120

DATED : March 22, 1977

INVENTOR(S) : Martin Reinheimer

It is certified that error appears in the above-identified patent and that said Letters Patent are hereby corrected as shown below:

Inventor's name should be changed from "Rheinheimer" to--Reinheimer.--

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*